US008256335B1

(12) United States Patent
Canon

(10) Patent No.: US 8,256,335 B1
(45) Date of Patent: Sep. 4, 2012

(54) BI-DIRECTIONAL CHAINSAW CHAIN

(76) Inventor: Wyatt Canon, Hermitage, PA (US)

( * ) Notice: Subject to any disclaimer, the term of this patent is extended or adjusted under 35 U.S.C. 154(b) by 158 days.

(21) Appl. No.: 12/800,640

(22) Filed: May 19, 2010

Related U.S. Application Data

(60) Provisional application No. 61/216,917, filed on May 21, 2009.

(51) Int. Cl.
*B27B 33/02* (2006.01)
*B27B 33/14* (2006.01)

(52) U.S. Cl. ..... 83/832; 83/830; 30/381

(58) Field of Classification Search ..... 30/381–387; 83/830–834, 835, 846, 848–850, 853–855
See application file for complete search history.

(56) References Cited

U.S. PATENT DOCUMENTS

| | | | | |
|---|---|---|---|---|
| 3,204,672 | A * | 9/1965 | Aitken | 83/834 |
| 3,945,288 | A | 3/1976 | Olmr | |
| 4,218,820 | A * | 8/1980 | Cleva | 30/166.3 |
| 6,061,915 | A * | 5/2000 | Seigneur et al. | 30/386 |
| 6,837,138 | B2 * | 1/2005 | Mang | 83/830 |
| 2003/0051351 | A1 * | 3/2003 | Buchholtz et al. | 30/383 |
| 2004/0025355 | A1 * | 2/2004 | Harfst | 30/381 |

* cited by examiner

*Primary Examiner* — Phong Nguyen

(57) ABSTRACT

A saw chain which is reversible having adjacent chain sections each having a pair of cutting links with cutting teeth disposed on opposite sides of the chain having flanged cutting teeth extending over the chain. The cutting edge on the pairs of cutting teeth on adjacent sections are oppositely disposed so that when the chain becomes dulled it can be reversed on the chain saw bar to reverse the chain sections to place sharp teeth in the cutting position and the previously used teeth are in a non-cutting position.

3 Claims, 1 Drawing Sheet

BI-DIRECTIONAL CHAINSAW CHAIN

CROSS-REFERENCE IS MADE TO RELATED APPLICATION

This application is based on U.S. Provisional Patent Application Ser. No. 61/216,917, filed May 21, 2009, of the same title.

FIELD OF THE INVENTION

The present invention relates to chainsaws and more particularly to chains for chainsaws which have adjacent pairs of cutting teeth oppositely arranged so the chain may be reversed on the bar to provide a sharp set of cutting teeth in a cutting position.

BACKGROUND OF THE INVENTION

The chainsaw is an extremely efficient and versatile tool which can be used by the individual for small cutting tasks such as cutting firewood or clearing brush. Chainsaws are also used professionally by those in the lumber industry for clearing and for cutting timber and large trees. Chainsaws are also used by firefighters, emergency workers and others.

The basic chainsaw may be powered either by a small engine such as a two-stroke, air-cooled engine or, in some applications, may be powered an electric motor. The conventional chainsaw has a shaft which drives a sprocket which may be connected to the shaft through a clutch. An endless chain is driven by the sprocket and is guided along a slot in an elongate chainsaw bar. The conventional chain has a plurality of links including cutting links and raker teeth which control the depth of the cut.

The cutting teeth and raker teeth project outwardly from the bar. The drive links extend downwardly and ride in a longitudinal channel or groove in the chainsaw bar. The teeth are connected by connecting links at pins or rivets to allow the chain to be continuously driven in the track or channel by the engagement of the drive links with the sprocket.

Several problems exist with conventional chains. Once the chain cutting teeth become dull or damaged as the result of use or, perhaps, encountering a hard object such as a nail or a rock, the chain must be removed, the teeth sharpened and the chain replaced on the saw. When this occurs, some users, particularly less experienced users, often reinstall the chain backwards so that the teeth will not effectively cut. Further the procedure of having to remove the chain and either sharpen the chain or take it to a facility for sharpening, requires substantial time and interruption of the task at hand.

BRIEF SUMMARY OF THE INVENTION

Briefly, the present invention provides a saw chain which has teeth configured and arranged so the chain may be reversed on the bar. The result is that if the chain becomes damaged or dull, the user can simply remove the chain, reverse the chain on the cutting bar and resume the cutting operation without the necessity of having to have the chain sharpened until the chain becomes dull after having been reversed. Thus, the life of a chain is effectively doubled.

The chain utilizes conventional parts, such as teeth and links, which are assembled in such a manner so that the chain is reversible on the chain saw bar.

Reversibility is achieved by having alternate chain sections with adjacent pairs of opposed cutting links. Each cutting link, when in the cutting position, has a forward blade section which chips from the bottom of the cut and a spaced apart, generally L-shaped cutting surface projecting upwardly and outwardly from the body of the cutting link. The L-shaped cutting surface chips material away from the wall of the cut. A cutting link is pivotally linked to a sprocket tooth and to a connecting link which, in turn, connects to an adjacent sprocket tooth and an adjacent cutting link. The adjacent cutting link also has a body with a forward section and an L-shaped cutting surface which extends upwardly and outwardly from the body of the tooth.

The adjacent drive or sprocket links are oriented having tips or fingers facing one another so that every other sprocket link is engaged by the sprocket. Thus, one set of alternating sprocket links operates to drive the chain in a first cutting direction and the other set of alternating sprocket links operates to drive the chain in a second cutting direction when reversed. The drive or sprocket link also serves to clean the dust and debris from the bar slot.

The chainsaw chain of the present invention has alternating cutting sections arranged forming continuous chain. Each chain cutting section has two cutting links configured as described above. Each chain section is separated from the adjacent chain section by a pair of opposed drive links. The adjacent cutting sections have their cutting links reversed so that one pair of links cuts in one direction having their cutting edges in leading position and the adjacent pair of cutting links have their cutting edges in a trailing, non-cutting position. When the chain is reversed, the non-cutting links are placed in a cutting position with their cutting edges leading. The chain sections, which were previously in a cutting position, now have the cutting edges of the cutting links in a trailing position. The cutting links in each chain section are disposed so that the cutting teeth are on opposite sides of the chain. Selected links may be provided with anti-kick features.

BRIEF DESCRIPTION OF THE DRAWINGS

The above and other advantages and objects of the present invention will become more apparent when taken in conjunction with the following description, claims and drawings in which:

DETAILED DESCRIPTION OF THE DRAWINGS

Figure 1:
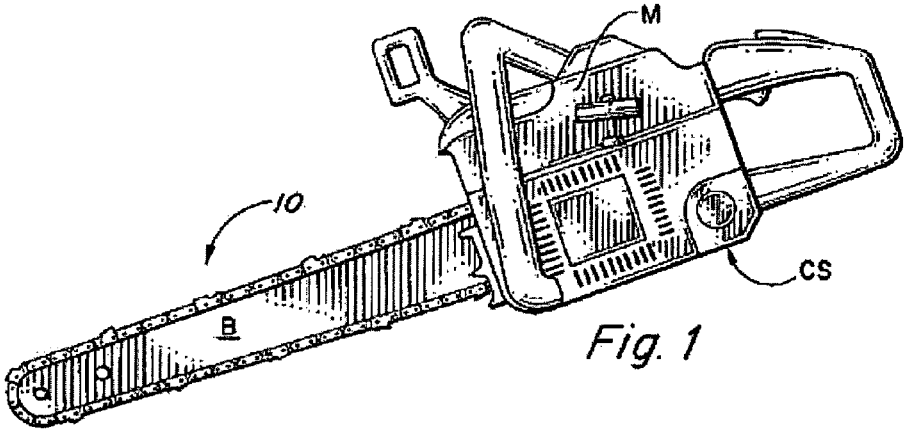
FIG. 1 is a perspective view of a representative chainsaw having a chain bar and saw chain.
Figure 2:
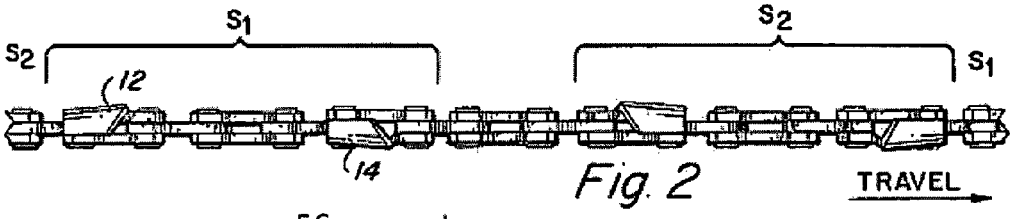
FIG. 2 is a top view of a section of the chainsaw chain of FIG. 1.
Figure 3:
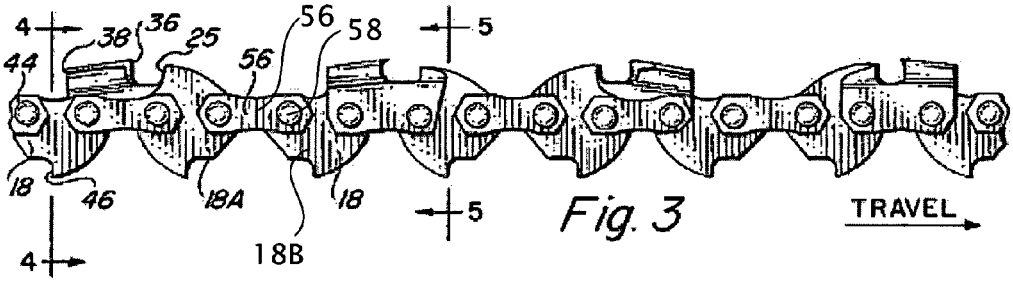
FIG. 3 is a side view of a section of chainsaw chain according to the present invention.

Turning now to the drawings, the saw chain 10 is an endless chain which travels along a bar B of a chainsaw CS powered by a motor M. The chainsaw CS has a motor driven sprocket as is conventional and is not shown. The chain has alternating chain sections S1 and S2. A plurality of sections S1 and S2 are sequentially arranged forming continuous chain 10. As shown in FIGS. 2 and 3, sections S1 are positioned to perform the cutting operation as the chain travels in the direction of the arrow. The adjacent sections S2 are positioned so the blade edges associated with the cutting links in these sections are in a non-cutting position when the chain is operated in the direction of travel shown. However, when the chain position is reversed on the chainsaw bar, the chain sections S2 are then placed in the cutting position and chain sections S1 are in a non-cutting position. The same numerals are used to identify the same components although they may be positionally reversed.

Figure 4:
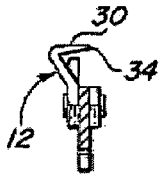
FIGS. 4 and 5 are cross-sectional views respectively taken along lines 4-4 and lines 5-5 of FIG. 3.
Figure 5:
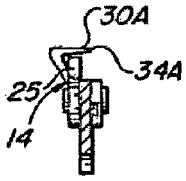

Chain section S1 includes spaced-apart cutting links 12 and 14. Links 12 and 14 are similarly configured and are on opposite sides of the chain as seen in FIGS. 4 and 5. Link 14 is shown in detail in FIG. 6, has an elongate body 15 which is generally planar fabricated from a suitable, high-quality steel. The body 15 has a pair of aligned bores 16 which each receive pins or rivets 20 pivotally securing the cutting link at opposite ends to sprocket drive links 18. A raker tooth 25 projects upwardly from the forward end of the cutting link 12. The raker tooth 25 has an upwardly converging surface terminating at tip end 26.

A cutting tooth 30 is located at the rear of the cutting link 12 and a space 32, shown as being generally U-shaped, is provided between the trailing edge of the raker tooth 24 and the forward edge of the cutting tooth 30.

As best seen in FIGS. 2, 3, 4, 5 and 6, cutting tooth 30 projects outwardly from the body 15 of the cutting link 12 and terminates at a flanged cutting edge 34. The cutting tooth 30 tapers downwardly and rearwardly from its forward edge 36 to its rear edge 38. It will be seen that the cutting teeth are secured to the drive links 18 at rivets 44 at the forward and rearward ends of the body. The flange 34 of tooth 30 extends substantially across the width of the chain, as best seen in FIG. 2.

In the travel of the chain, as indicated by the arrow in FIGS. 2 and 3, the drive teeth 18 of each chain section S1 will be engaged by the sprocket to drive the chain. The adjacent drive links 18 are in a non-driven position and will be engaged by the sprocket when the chain is reversed. The recesses or grooves 46 in the lower edge of the drive links serve to clean the bar slot as the drive links pass along the bar slot.

In order to comply with the American National Standards Institute ('ANSI'), chainsaws under 62 cc's must have an anti-kickback chain. Selected links are configured as anti-kick links which are well known and generally feature a ramp that helps the chain to feed smoothly, preventing too deep a cut. Reference is made to U.S. Pat. No. 4,425,830.

Drive link 18A in section S1 is connected to the next adjacent drive link 18B by a connecting link 56. The connecting link 56 has rivets or pivot pins 58 at its opposite ends which pivotally connects to the adjacent drive link 18. The connecting link 56 has sections on both sides of the chain, as seen in FIG. 2.

Figure 6:
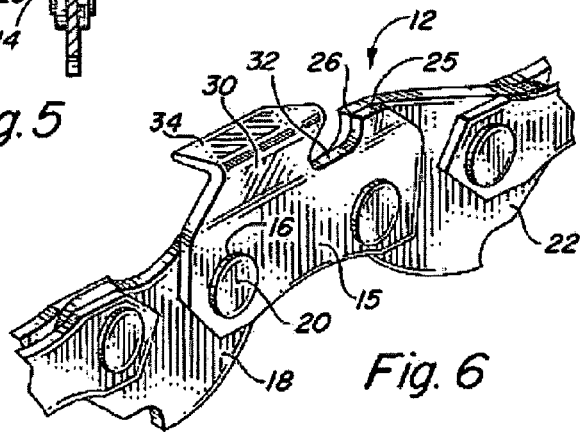
FIG. 6 is a perspective view of an individual cutting link in a section, the orientation depending on the intended cutting direction.

Pivotally connected to drive link 18 is the next adjacent cutting link 14, which is shown in FIGS. 5 and 6. Cutting link 14 has a generally flat, elongate body with a forward edge and a rearward edge. A raker tooth 25 projects upwardly at the forward end of the cutting link and is spaced from the cutting tooth 30 by a generally U-shaped recess 32. The cutting tooth 30 is generally U-shaped having a projecting flange 34. The tooth section has a forwardly projecting apex and an edge which extends rearwardly. The cutting tooth, again, is slightly rearwardly inclined (opposite the direction of travel when in the cutting position) from the forward edge to the rear edge of the tooth. It is to be noted that the cutting link 14 is secured on the side of the chain opposite link 12 so that adjacent cutting links 12, 14 are oppositely disposed along the chain with their respective flanges 34 facing inwardly toward the center of the chain.

The next adjacent chain section S2 is interposed between two sections S1 which are as described above. Alternate sections S1 perform the cutting operation in the direction of chain travel indicated by the arrow. Alternating sections S2, when positioned as shown, are not in a cutting position until the chain is reversed on the bar placing sections S2 in the position shown for sections S1. Cutting section S2, when reversed is identical to section S1 having cutting links 12 and 14. Each link is pivotally connected by rivets or pins to drive links. The sprocket links are pivotally connected by connecting links. Section S2 in the position shown has its drive links 18, 18A in a non-driven position and its teeth 30 are in a trailing, non-cutting position.

In use, chainsaw chain 10, as described above, has a plurality of alternating chain sections or segments S1, each containing a pair of cutting links connected to sprocket links and connecting links. The adjacent cutting links in each chain section are disposed on opposite sides of the chain so that the projecting flanged cutting teeth project in facing relationship spaced-apart from one another.

The next adjacent chain section S2 also has a pair of cutting links, but the links are oppositely arranged. Therefor, only the alternating sections S1 of the chain perform the cutting operation. Once the chain is removed from the chain bar and reversed, the cutting sections are reversed and the cutting sections S2 which previously were not in a cutting position are now in a cutting position. Since the sections S2 were not performing the cutting operation, they remain sharp, ready for use.

The chain of the present invention can be provided in various pitches as for example ¼" or ⅜". Similarly, the gauge may be selected from a range of standard gauges such as 0.043," 0.050," 0.058," or 0.063."

The chainsaw chain of the present invention provides substantial advantages. The chain solves a problem often encountered as user's will often put a chain on the saw bar backwards. Since the chain of the present invention cuts in both directions, the user, when putting a new of sharpened chain on, does not have to be concerned with the particular orientation.

Once the chain becomes dull due to use or damaged due to striking hard objects such as nails and rocks, the user can simply remove the chain by loosening the chain bar and reversing the chain, resulting in extending the chain life and the trailing edge of the cutting links that were previously in a non-cutting position now become the leading edge in a position to perform the cutting operation.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A bi-directional chain for a chainsaw comprising:

(a) a continuous chain having opposite sides having a plurality of alternating first and second link sections pivotally connected to one another;

(b) said first link sections each having a first cutting link disposed on a first side of the chain with opposite first and second ends, said first cutting link pivotally connected at its first end to a first drive link, said drive link having a groove oriented to drive the chain in a first direction, said first cutting link having a cutting tooth on its first end projecting transversely across the chain and having a raker tooth spaced from said cutting tooth, said first cutting link pivotally connected to a second drive link at its second end, said second drive link defining a groove oriented to drive the chain in a second opposite direction;

(c) said first link sections having a second cutting link disposed on the second side of the chain and having opposite first and second ends pivotally connected at a first end to a third drive link, said third drive link having a groove oriented to drive the chain in a first direction, said second cutting link having a cutting tooth on its first end projecting transversely across the chain and having a raker tooth spaced from said cutting tooth, said cutting link pivotally connected to a fourth drive link at its second end, said fourth drive link defining a groove oriented to drive the chain in a second direction;

(d) said second link sections having a first cutting link disposed on the first side of the chain with opposite first and second ends, said cutting link pivotally connected at its first end to a fifth drive link, said fifth drive link having a groove oriented to drive the chain in a first direction, said cutting link having a cutting tooth at its second end projecting transversely across the chain and having a raker tooth spaced from said cutting tooth, said cutting link pivotally connected to a sixth drive link at its second end, said sixth drive link defining a groove to drive the chain in a second direction; and (e) said second link sections having a second cutting tooth disposed on the second side of the chain with opposite first and second ends, said cutting link pivotally connected at its first end to a seventh drive link, said seventh drive link having a groove oriented to drive the chain in a first direction, said cutting link having a cutting tooth at its second end projecting transversely across the chain and having a raker tooth spaced from said cutting tooth, said cutting link pivotally connected to an eighth drive link at its second end, said eighth drive link defining a groove to drive the chain in a second direction.

2. The bi-directional chain of claim 1 wherein selected of the chain links include anti-kickback features.

3. The bi-directional chain of claim 1 wherein the chain is provided in various selected lengths, gauges and pitches.

* * * * *